US009826800B2

(12) United States Patent
Reimann et al.

(10) Patent No.: US 9,826,800 B2
(45) Date of Patent: Nov. 28, 2017

(54) BELT BUCKLE FOR A SAFETY BELT SYSTEM

(71) Applicant: Autoliv Development AB, Vårgårda (SE)

(72) Inventors: Norbert Reimann, Amelinghausen (DE); Ole Scharnberg, Hamburg (DE)

(73) Assignee: AUTOLIV DEVELOPMENT AB, Vargarda (SE)

( * ) Notice: Subject to any disclaimer, the term of this patent is extended or adjusted under 35 U.S.C. 154(b) by 33 days.

(21) Appl. No.: 14/900,879

(22) PCT Filed: Jul. 1, 2014

(86) PCT No.: PCT/EP2014/063924
§ 371 (c)(1),
(2) Date: Dec. 22, 2015

(87) PCT Pub. No.: WO2015/000881
PCT Pub. Date: Jan. 8, 2015

(65) Prior Publication Data

US 2016/0157563 A1 Jun. 9, 2016

(30) Foreign Application Priority Data

Jul. 3, 2013 (DE) ..... 10 2013 212 927

(51) Int. Cl.
*A44B 11/25* (2006.01)

(52) U.S. Cl.
CPC ..... *A44B 11/2576* (2013.01); *A44B 11/2546* (2013.01); *A44B 11/2561* (2013.01); *Y10T 24/45623* (2015.01)

(58) Field of Classification Search
CPC ..... Y10T 24/45623; A44B 11/2576; A44B 11/2546; A44B 11/2561; A44B 11/2523
See application file for complete search history.

(56) References Cited

U.S. PATENT DOCUMENTS

| | | | | |
|---|---|---|---|---|
| 4,454,634 | A | 6/1984 | Haglund et al. | |
| 8,955,204 | B2 * | 2/2015 | Scharnberg | A44B 11/2546 24/635 |
| 2010/0251523 | A1 * | 10/2010 | Scharnberg | A44B 11/2546 24/700 |
| 2013/0022767 | A1 * | 1/2013 | Klafke | A44B 11/2503 428/35.7 |

FOREIGN PATENT DOCUMENTS

| | | | |
|---|---|---|---|
| DE | 100 41 773 | A1 | 8/2000 |
| DE | 10 2008 022 675 | B3 | 8/2009 |
| EP | WO 2008/145274 | A2 | 12/2008 |

OTHER PUBLICATIONS

PCT International Search Report—dated Aug. 27, 2014.

* cited by examiner

*Primary Examiner* — Robert J Sandy
(74) *Attorney, Agent, or Firm* — Brinks Gilson & Lione

(57) ABSTRACT

A belt buckle for a safety belt system for latching a belt buckle (1) with a casing (4), and a locking mechanism (3) arranged in the casing (4), and a spring element (13) loading the latching mechanism (3) in the closing direction, and a damping element that acts against the closing direction of the lathing mechanism (3). The damping element is formed by a soft layer arranged on the inside of the casing (4) on an anticipated impact surface of one of the components of the latching mechanism (3) during the latching or unlatching movement (3).

10 Claims, 2 Drawing Sheets

BELT BUCKLE FOR A SAFETY BELT SYSTEM

CROSS REFERENCE TO RELATED APPLICATIONS

This application claims priority to German Application No. 10 2013 212 927.0, filed on Jul. 3, 2013 and PCT/EP2014/063924, filed on Jul. 1, 2014.

FIELD OF THE INVENTION

The invention relates to a belt buckle for a safety belt system for locking a belt tongue with a latch mechanism and a spring element which spring-loads the latch mechanism in the locking direction.

U.S. Pat. No. 4,454,634, for example, describes a belt buckle that has a latch mechanism that is spring-loaded in the direction of locking. The spring making contact with the latch mechanism is arranged in such a way that when the belt tongue is not inserted, it spring-loads the latch mechanism in the direction of opening, while it spring-loads it in the direction of locking when the belt tongue is inserted. In this way, only one spring is required for the functioning of the latch mechanism. With the insertion of the belt tongue, the arrangement of the parts of the latch mechanism relative to each other is changed, and in that way also the alignment of the spring, so that the latch mechanism is subjected to a changing spring load during the closing movement from the open position into the closed position. During the closing movement of the latch mechanism, there is passage through a neutral position, in which the latch mechanism is loaded neither in the open nor in the closed position. This unstable neutral position will subsequently be referred to as the dead point. After passage through the dead point, the buckle automatically snaps shut, whereby the speed of the closing movement after passage through the dead point increases until the movement is abruptly stopped after the closed position is reached.

Because in general the latch mechanism in belt buckles must be designed as load-bearing and is therefore preferably made of metallic materials, unwanted hard-sounding noises can occur during the closing movement of the latch mechanism. This is the case particularly when the closing movement, as described above, is stopped abruptly, so that the parts of the closing mechanism clap together at high momentum.

However, in modern motor vehicles, due to the stricter requirements for acoustic conditions in the vehicle interior, it is desirable that the noises occurring during locking of the belt buckle be reduced as much as possible.

In order to solve this problem, DE 10 2008 022 675 B3 provides for a damping element that works against the locking direction of the latch mechanism, wherein the deceleration of the latch mechanism toward the end of the closing movement, and thus the accompanying noise generation, is reduced. The damping element is in this case designed as a leaf spring, one end of which is firmly clamped to the buckle, and which has a loose end that is in contact with the latch mechanism, thus acting against the locking direction of the latch mechanism.

The purpose of the invention is thus to create a cost-efficient belt buckle with a preferably quiet latching mechanism of the belt tongue. The solution to this problem is found, according to this invention, by means of a belt buckle as described herein.

The present invention proposes a belt buckle for a safety belt system for latching a belt tongue that has a latch mechanism and a spring element that loads the latching mechanism in the locking direction and a damping element that acts against the locking direction, wherein according to the basic idea of the invention it is proposed that the damping element, during the latching and unlatching movement, is formed on an anticipated impact surface on the inside of the casing by a soft layer arranged on one of the structural elements of the latching mechanism.

Through the soft layer arranged on the inside of the casing on the anticipated impact surface, noise generation can be reduced, because the moving parts of the latching mechanism no longer directly strike the harder casing of the belt buckle, but rather the softer soft layer instead. The soft layer is characterized by a surface that is less hard than that of the casing, which therefore produces lower noise generation. The proposed solution reduces noise generation particularly effectively, because the actual production of the noise is limited. In addition, due to the soft layer, the transmission of the sound waves that are still produced on the casing can be reduced, and thus also the further propagation of these noises from the belt buckle to the outside. Furthermore, the momentum of the impact between components of the latching mechanism can be softened, so that in addition to that, the forces thus transferred to the buckle are smaller.

It is further proposed that the soft layer be glued to the inside of the casing, or that the soft layer is produced together with the casing in a 2K injection molding process, or that the soft layer is formed by an insert component that is inserted into a recess on the inside of the casing and secured against slipping out by a frame of the latching mechanism. All proposed solutions represent more cost-efficient embodiments of ways to arrange and secure the soft layer. With the 2K injection molding process, the actual fixation process is omitted, because during the injection process of the two-stage injection method, the softer plastic material of the soft layer is also sprayed onto the plastic material of the casing. Furthermore, the actual fixation process is also omitted with the solution according to which the soft layer is an inserted component, because in this case the inserted part is, for all intents and purposes, clamped between the frame and the casing. However, the inserted part may of course be glued to the casing or to the frame as well. Here it is particularly important that the soft layer is set firmly in its predetermined position relative to the latching mechanism, so that the component or components of the latching mechanism still strike the soft layer even after many latching and unlatching operations, and that in this way the noise damping effect is preserved.

In particular, the soft layer can be formed of a foam mass made of elastic plastic, in particular polyurethane. With a foam mass made of elastic plastic, the impact movement as such, and the noise caused by it, can be damped. In addition, the sound propagation of the sound waves inside the soft layer can be reduced by the hollow spaces present in the soft layer itself. Both effects help reduce the emission of noise from the belt buckle.

It is further proposed that the thickness of the soft layer be measured in such a way that a bar that is moved during the latching movement of the latching mechanism in the direction of the soft layer is immersed into the soft layer after the engagement of the buckle tongue. The part of the latching mechanism that essentially causes the noise generation is the bar of the latching mechanism which, in order to lock the belt buckle, engages a corresponding recess of the belt tongue. This bar, compared to the other moving components of the latching mechanism has, as a load-bearing component, the largest mass and performs the largest movements and undergoes the greatest acceleration during the latching and unlatching of the belt buckle, so that the bar, when it strikes the casing wall, has the greatest kinetic energy and thus substantially determines the noise generated. By means of the thickness and arrangement of the soft layer, the bar will be intercepted more softly, and that because of this, the sound waves generated will be reduced. In this way, the crucial source of noise generation during the latching and unlatching movement of the latching mechanism will be damped, so that noise generation can be very effectively reduced at very little cost.

In so doing, the effect of the soft interception of the bar can be further reinforced if the soft layer has a flat base section and a cushion-like damping section provided on the flat base section, wherein the soft layer is positioned on the inside of the casing so that the bar, in a final phase of the latching movement, submerges into the damping layer. The soft layer has two sections in its basic structure, which are a flat base section to fix the soft layer to the casing and, arranged on the surface of the base section, the damping layer into which the bar immerges in order to dampen noise generation.

BRIEF DESCRIPTION OF THE DRAWINGS

The invention will be explained below by means of a preferred realization example with reference to the annexed figures. Shown here are.

DETAILED DESCRIPTION

Figure 1C:
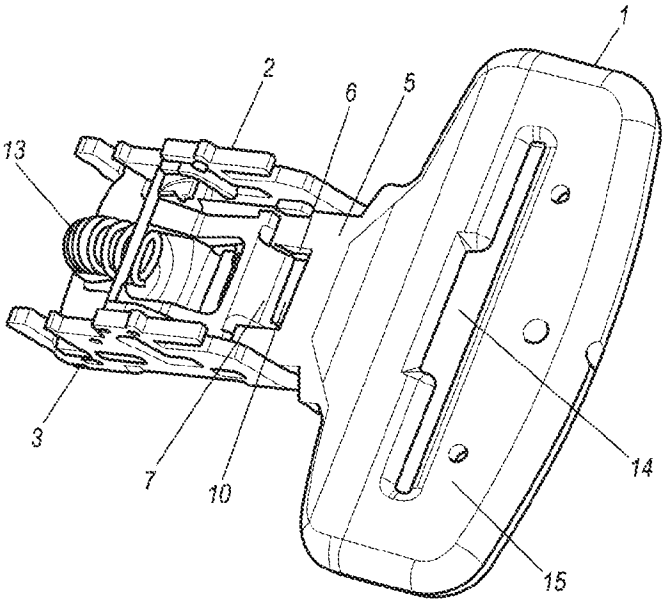
FIGS. 1(*a*), 1(*b*), and 1(*c*) show a belt tongue with a latching mechanism and an insert component; with FIG. 1(*a*) showing the latching mechanism and belt tongue separated, FIG. 1(*b*) is similar to FIG. 1(*a*) but showing the insert component separated, and FIG. 1(*c*) showing the belt tongue fastened to the latching mechanism.
Figure 1A:
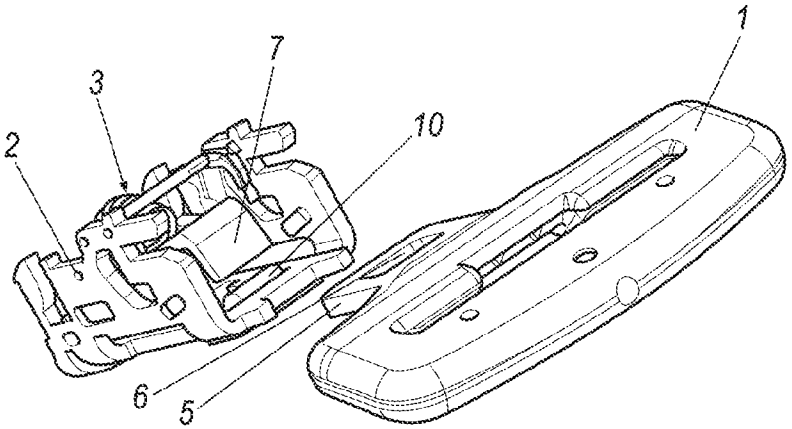
Figure 1B:
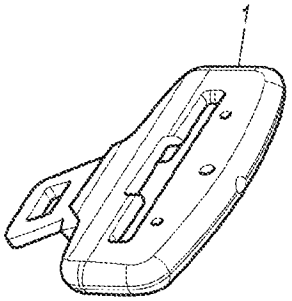
Figure 1B:
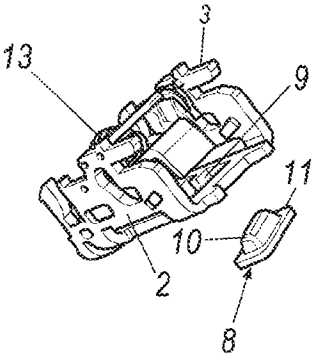
Figure 2:
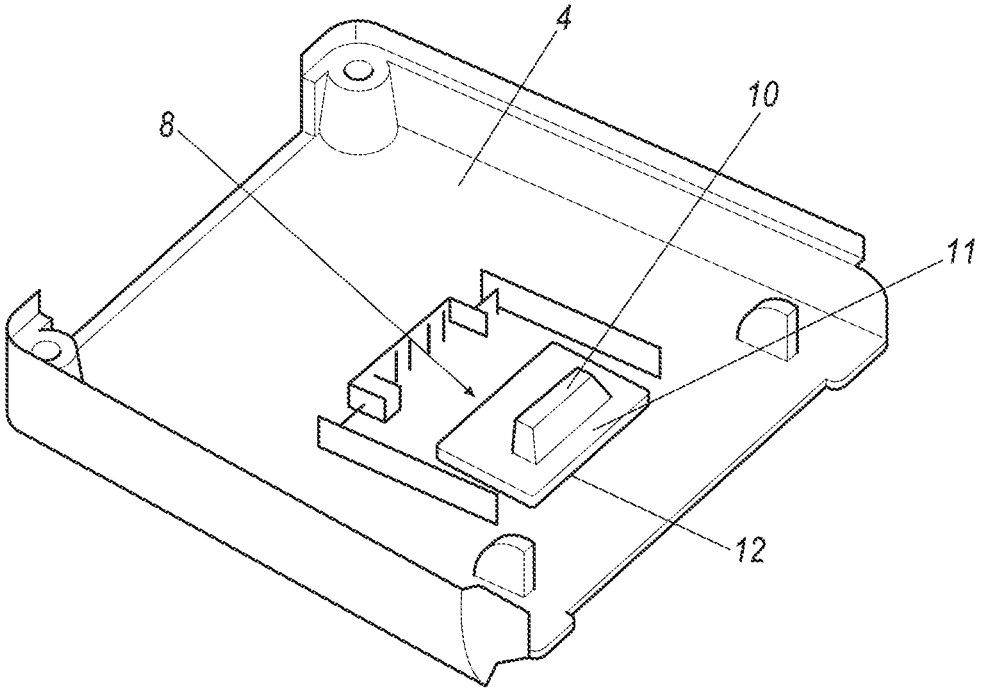
FIG. 2 shows a half casing of the belt buckle with the insert component arranged therein.

Seen in FIGS. 1(*a*), 1(*b*), and 1(*c*) is a frame 2 with a latching mechanism 3 of a belt buckle arranged therein and a belt tongue 1 of a safety-belt device of a motor vehicle. As basic components, in addition to others that are important for the latching and unlatching mechanism of the belt tongue 1, the latching mechanism 3 includes a spring 13 and a bar 7. The belt tongue 1, in addition to a deflection section 15 with a through-opening 14 for the safety belt of the safety-belt device, includes an interlock plate 5 with a locking opening 6. When the belt tongue 1 with the interlock plate 5 is inserted into an insertion slot of the belt buckle, the bar 7, by means of a mechanism known to the state of the art and therefore not described in detail here, is swiveled due to the spring force exerted by the spring 13 and in this way engages the locking opening 6 of the interlock plate 5 so that the belt tongue 1 is then tightly held inside the belt buckle. This latching movement takes place after the previously described dead point has been overcome by a strong acceleration of the bar 7 and a sudden deceleration of the bar 7 in the locked position.

Also provided is an insert component 8 that has a flat base section 11 and a cushion-like damping section 10 provided on the base section 11. The insert component 8 butts against the outside of the frame 2 and engages, by means of the cushion-like damping section 10, into an aperture 9 of the frame 2. The insert component 8 is positioned such in this position that the cushion-like damping section 10 comes to rest approximately opposite the front side of the bar 7 that has been swiveled into the unlocked position. In order to fix the insert part 8, it is inserted into a corresponding recess 12 of the half casing section of a casing 4 and, if required, glued in place there. The half casing has a structure including the casing edges and protruding ridges, which enables the insertion of the frame 2 with the latching mechanism 3 arranged inside it into only one position, in which the insert part 8 engages into the aperture 9 of the frame 2 with the damping section 10. In that way, the insert component 8 is fixed between the frame 2 and the half casing and, in addition, it cannot slip to the side due to the engagement into the recess 12.

The damping section 10 has a cushion-like shape and extends from the surface of the base section 11 so that the insert component 8 has a considerably greater thickness in this section. The outside perimeter of aperture 9 is deliberately designed as smaller than the surface of the base section 11 so that the insert component 8 rests with the edge of the base section 11 against the outside of the frame 2 in the region of the edge surface of the aperture 9 and cannot pass completely through the aperture 9. The edge surface of the base section 11 thus forms a kind of abutment, by means of which the insert component 8 is wedged between the frame 2 and the half casing. The insert component 8 is made of a soft foam-like plastic, such as, for example, polyurethane. When the belt tongue 1 is inserted into the insertion slot of the belt buckle, the bar 7, supported by the spring force of the spring 13, is swiveled and engages the locking opening 6 of the interlock plate 5. The insert component 8 is arranged so that the damping section 10 covers an anticipated impact surface of the bar 7 on the inside of the half casing, so that the bar 7, in the final phase of the swivel movement, submerges with its front end section into the soft damping section 10. This results on the one hand in noise generation being reduced from the start, and on the other hand in the propagation of residual noise being additionally damped by the soft material of the insert component 8. Both effects contribute to a result where the belt tongue is locked into the belt buckle, noise emission outside is significantly reduced, and the locking procedure is quieter.

The insert component 8 forms a soft layer on the half-casing of casing 4 which prevents a direct impact of the bar 7 on the surface of the harder casing 4. The insert component 8, or as the case may be the soft layer, is arranged on casing 4 so that it covers the section of casing 4 that is arranged opposite the front end of the tilted bar 7, the section of the casing being the section that the bar 7 would otherwise impact.

Instead of the insert component 8, the soft layer can also be sprayed or molded directly onto the casing 4 in a two-stage injection molding process, in which case the assembly operation of inserting the insert part 8 can be omitted.

It is particularly important for the noise reduction from the belt buckle that the soft layer, i.e. in this case the insert component 8, be arranged in casing 4 against the anticipated impact surface of the bar 7 in the locking direction of the latching mechanism 3. The locking direction is understood as the direction in which bar 7 of the latching mechanism moves to the side with its front end. The section of casing 4 on which the insert component 8 should be arranged is thus the section of casing 4 toward which bar 7 is swiveled with its free front end. If bar 7 is moved with another surface closer to casing 4 and can come to rest there, the insert part 8 or as the case may be the soft layer, could be assigned to this section of casing 4, or an additional soft layer could also be provided on another, second anticipated impact surface of casing 4. This, depending on the structure of the latching mechanism 3, can also be a surface of the casing 4 that is arranged laterally to the bar 7, as long as the rod, during the unlatching or latching movement, can come to rest against it.

The thickness of the insert component 8 or, as the case may be, of the soft layer can be such that the bar 7 in each case comes to rest in a damping manner against the soft layer. Alternatively, the thickness of the soft layer can be such that the bar 7 or other parts of the latching mechanism 3 only come to rest against or submerge into the soft layer during extreme accelerations and extreme movements.

Furthermore the frame 7 of the latching mechanism 3 can also be elastically supported against the casing 4 at least to a small degree by the insert component 8, by which means the structure-borne sound transmission from the frame 2 to casing 4 can be reduced.

While the above description constitutes the preferred embodiment of the present invention, it will be appreciated that the invention is susceptible to modification, variation and change without departing from the proper scope and fair meaning of the accompanying claims.

The invention claimed is:

1. A belt buckle for a safety belt system for locking a belt tongue comprising:

a casing, a latching mechanism arranged in the casing, the latching mechanism including a frame forming an aperture, a spring element loading the latching mechanism in a locking direction of locking with the belt tongue, a damping element that contacts a bar component of the latching mechanism during a movement of the bar component in the locking direction of the latching mechanism, and the damping element is formed by a soft layer arranged on the inside of the casing extending through the aperture and positioned on an anticipated impact surface of the bar component of the latching mechanism during a locking movement in the direction of locking or an unlocking movement.

2. A belt buckle according to claim 1, further comprising: the soft layer is glued onto an inside surface of the casing.

3. A belt buckle according to claim 1, further comprising; the soft layer together with the casing are produced by a two shot injection molding process.

4. A belt buckle according to claim 1, further comprising; the soft layer is formed by an insert component that is inserted into a recess provided on an inside surface of the casing and which is secured against slipping out by the frame of the latching mechanism.

5. A belt buckle according to claim 1, wherein the soft layer is formed of a foam mass comprising an elastic polyurethane.

6. A belt buckle according to claim 1, further comprising; the thickness of the soft layer is such that the bar component of the latching mechanism moved during the locking movement of the latching mechanism in the direction of the soft layer submerges into the soft layer after the locking of the belt tongue.

7. A belt buckle according to claim 6, further comprising; the soft layer has a flat base section and a cushion-like damping section provided on the flat base section, wherein the soft layer is positioned on an inside surface of the casing so that the bar in an end phase of the locking movement submerges into the damping section.

8. A belt buckle according to claim 1, further comprising; the damping element forming a flat base section and a cushion like damping section forming the soft layer, the flat base section clamped between the casing and the frame with the damping section extending through the aperture.

9. A belt buckle according to claim 8, further comprising; a portion of the flat base section rests against an outside of the frame in a region surrounding the aperture such that the damping element cannot pass completely through the aperture.

10. A belt buckle according to claim 1, further comprising;

the damping element affixed to the casing or formed integrally by the casing and extending through the aperture.

* * * * *